United States Patent [19]

Shioda

[11] Patent Number: 4,609,298

[45] Date of Patent: Sep. 2, 1986

[54] TENSIONING MEANS FOR PRINTING RIBBON CASSETTE

[75] Inventor: Junji Shioda, Nagoya, Japan

[73] Assignee: Brother Kogyo Kabushiki Kaisha, Nagoya, Japan

[21] Appl. No.: 659,260

[22] Filed: Oct. 10, 1984

[30] Foreign Application Priority Data

Oct. 14, 1983 [JP] Japan ..... 58-159424[U]

[51] Int. Cl.[4] ..... B41J 32/00

[52] U.S. Cl. ..... 400/208; 400/228; 400/234

[58] Field of Search ..... 400/207, 208, 208.1, 400/228, 234; 242/75, 75.2, 75.3, 189, 190, 192, 197, 198, 199, 200; 360/96.1, 96.3, 96.5, 132

[56] References Cited

U.S. PATENT DOCUMENTS

| | | | |
|---|---|---|---|
| 3,520,495 | 7/1970 | Sotani | 400/208 X |
| 4,299,504 | 11/1981 | Benz et al. | 400/208 |
| 4,339,210 | 7/1982 | Craft et al. | 400/208 |
| 4,350,451 | 9/1982 | Furrow | 400/208 |
| 4,401,394 | 8/1983 | Hume et al. | 400/208 |
| 4,402,621 | 9/1983 | Abell, Jr. et al. | 400/208 |
| 4,428,695 | 1/1984 | Jamieson | 400/234 X |
| 4,479,730 | 10/1984 | Yoshioka et al. | 400/208 |
| 4,492,483 | 1/1985 | Guillaume | 400/208 |
| 4,502,801 | 3/1985 | Hefti et al. | 400/208 |
| 4,521,125 | 6/1985 | Turbon | 400/208 |

FOREIGN PATENT DOCUMENTS

| | | | |
|---|---|---|---|
| 0122755 | 10/1984 | European Pat. Off. | 400/208 |
| 2113149 | 8/1983 | United Kingdom | 400/208 |

OTHER PUBLICATIONS

IBM Technical Disclosure Bulletin, "Off-The-Carrier Ribbon Feed", McCornack, vol. 27, No. 4A, Sep. 1984, pp. 2292–2293.

*Primary Examiner*—Ernest T. Wright, Jr.
*Attorney, Agent, or Firm*—Leydig, Voit & Mayer, Ltd.

[57] ABSTRACT

A printing ribbon cassette having in a casing a supply spool carrying a printing ribbon thereon and a take-up spool on which the ribbon is wound as it is released from the supply spool having an axis of rotation which is movable as the ribbon is released therefrom. A ribbon tensioner in the casing has a base rotatably supported on a supply spool shaft, and one end engaged with the ribbon released from the supply spool, while the other end of the tensioner is engaged with a guide member in the casing. The outer end of the tensioner is movable along the guide member with the displacement of the supply spool shaft to enable one end of the tensioner to maintain a constant range of tension on the ribbon.

9 Claims, 4 Drawing Figures

TENSIONING MEANS FOR PRINTING RIBBON CASSETTE

BACKGROUND OF THE INVENTION

1. Field of the Invention

This invention relates to a tensioning means for ribbon cassette for a typewriter, printer, etc. having a supply spool carrying the unused portion of a printing ribbon and a take-up spool on which the used portion of the ribbon is wound.

2. Description of the Prior Art

In a ribbon cassette for a typewriter, printer, etc., it is necessary to provide a tensioning device for applying tension to the printing ribbon on the supply spool. As the printing ribbon is used, its diameter on the supply spool becomes smaller. If the supply spool is of the type which is movable in one direction, its movement brings about a change in the spring force which applies the tension and thereby in the tension on the printing ribbon. This change disables clear printing.

SUMMARY OF THE INVENTION

It is an object of this invention to provide a tensioning means for printing ribbon cassette in which an appropriate amount of tension is maintained on a printing ribbon to enable it to perform clear and accurate printing even if a supply spool is moved as the ribbon is used. It is another object of this invention to provide a tensioning means for printing ribbon cassette having a supply spool, a supply spool shaft, a take-up spool and a take-up spool shaft which are smoothly movable.

These objects are attained by a tensioning means for printing ribbon cassette comprising a supply spool for a printing ribbon having an axis of rotation which is movable as the ribbon is released from the supply spool, a take-up spool on which the ribbon released from the supply spool is wound, a casing accommodating the supply and take-up spools, a ribbon tensioner having a base end secured to a supply spool shaft and a pair of free ends one of which is engaged with the ribbon released from the supply spool for applying tension thereto, and guide means provided in the casing engageably with the other free end of the ribbon tensioner, the other free end of the ribbon tensioner being movable on the guide means with the release of the ribbon from the supply spool to enable the one free end of the ribbon tensioner to apply a constant range of tension to the ribbon.

Other objects of this invention will become apparent from the following description and the appended claims, and a lot of advantages not herein stated will be obvious to anybody of ordinary skill in the art if he carries out this invention.

DETAILED DESCRIPTION OF THE PREFERRED EMBODIMENT

Figure 1:
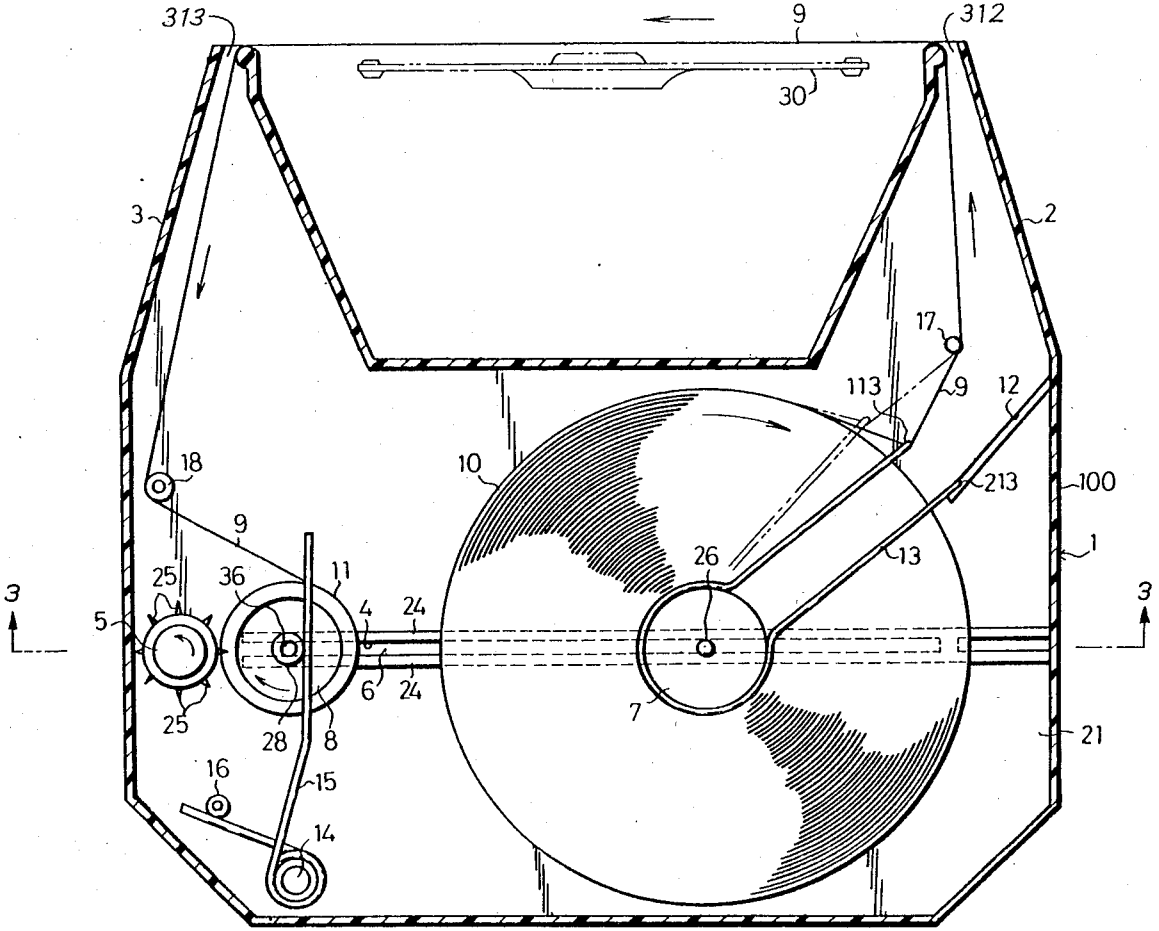
FIG. 1 is a top plan view, partly in section, of a ribbon cassette embodying this invention, in which a printing ribbon has just begun to be used.

Referring to the drawings in further detail, a printing ribbon cassette embodying this invention comprises a casing 1 having a spool housing 100 and a pair of guide arms 2 and 3 extending rearwardly from the spool housing 100. The casing 1 also has a bottom wall 21 on which a pair of transversely extending guide rails 24 are formed. The guide rails 24 define a guide groove 4 therebetween. A drive roller 5 is rotatably provided between the top and bottom walls 31 and 21 of the casing 1 beyond the left extremity of the guide groove 4. The roller 5 has a pluraltiy of pointed projections 25 on its outer periphery. If the cassette is mounted in a typewriter or like printer, a printing head 30 (daisy-type-wheel in FIG. 1) is disposed between the guide arms 2 and 3, and the drive roller 5 is connected to a drive mechanism in the printer so that it may be rotated by a predetermined angle counterclockwise in FIGS. 1 and 2 simultaneously with each printing operation of the daisy-type-wheel 30.

Figure 3:
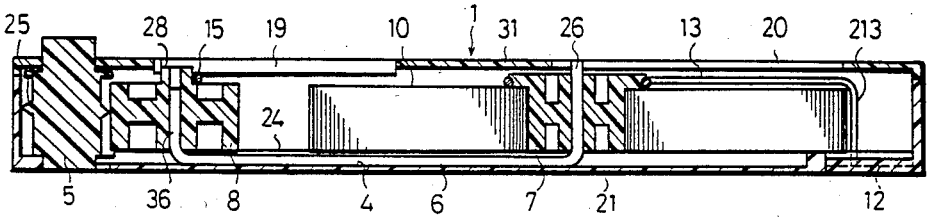
FIG. 3 is a sectional view taken along the line 3—3 of FIG. 1.

A connecting member 6, which is formed from a wire, is fitted in the guide groove 4 and movable along the guide groove 4. The connecting member 6 has a pair of upwardly bent ends 26 and 36, as shown in FIG. 3. Two spool shafts 7 and 8 are rotatably supported on the bent ends 26 and 36, respectively. The right spool shaft 7 carries the unused portion of a printing ribbon 9 thereon to define a supply spool 10, while the used portion of the printing ribbon 9 is wound on the left spool shaft 8 defining a take-up spool 11. The spool shafts 7 and 8 and the spools 10 and 11 are supported on the guide rails 24.

The spool shafts 7 and 8 and the spools 10 and 11 are, thus, caused by the connecting member 6 to move together on the guide rails 24 along the guide groove 4. The projections 25 on the drive roller 5 are engaged with the outer periphery of the take-up spool 11 to transmit the rotation of the drive roller 5 to the take-up spool 11. The rotation of the drive roller 5 by a predetermined angle causes the take-up spool 11 to rotate clockwise in FIGS. 1 and 2, and thereby enables the unused printing ribbon 9 to be released from the supply spool 10 and travel past a guide pin 17, outwardly through the end opening 312 of the right guide arm 2 and to the left between the guide arms 2 and 3. The printing ribbon 9 effects printing between the guide arms 2 and 3, travels into the end opening 313 of the left guide arm 3 and past a guide pin 18, and is wound on the take-up spool 11.

The top wall 31 of the casing 1 has two guide grooves 19 and 20 located immediately above the opposite end portions, respectively, of the guide groove 4, as shown in FIG. 3. The spool shaft 8 has at its top a central boss 28 engaged in the guide groove 19, while the right bent end 26 of the connecting member 6 is engaged in the other groove 20.

Figure 4:
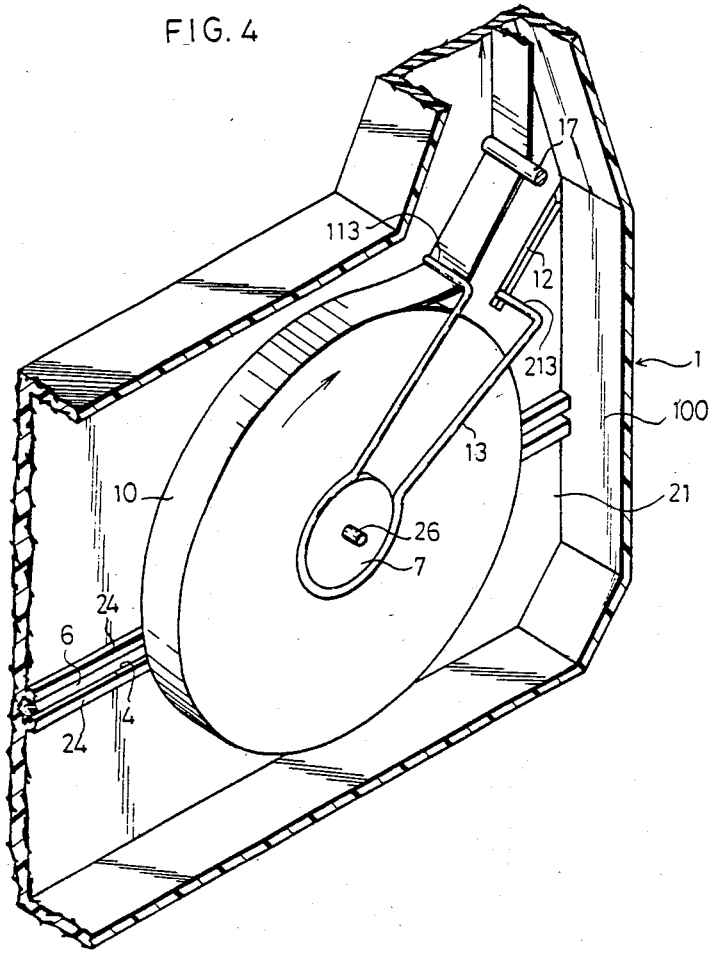
FIG. 4 is a partly omitted perspective view showing in greater detail how a ribbon tensioner is engaged with the printing ribbon and guide means.

The bottom wall 21 of the casing 1 has a straight guide groove 12 lying at an angle to the sidewall of the casing 1 and terminating in the vicinity of the supply spool 10, as is best shown in FIG. 4.

A bifurcate ribbon tensioner 13, which is formed from a spring wire, has a rounded base end supported rotatably on the shaft 7 at the top of the supply spool 10. The ribbon tensioner 13 has a pair of legs extending radially outwardly of the supply spool 10 and terminating in perpendicularly downwardly bent ends 113 and 213, respectively. One of the ends which is shown at 113 is engaged on the printing ribbon 9 released from the supply spool 10 to apply tension thereto, while the other end 213 is slidably engaged in the guide groove 12. The guide groove 12 guides the other end 213 of the ribbon tensioner 13 in such a manner that there may not be any appreciable change in the angle of the ribbon tensioner 13 and the distance between the ends 113 and 213 thereof in the event the supply spool 10 has moved from its position in FIG. 1 to its position in FIG. 2.

Figure 2:
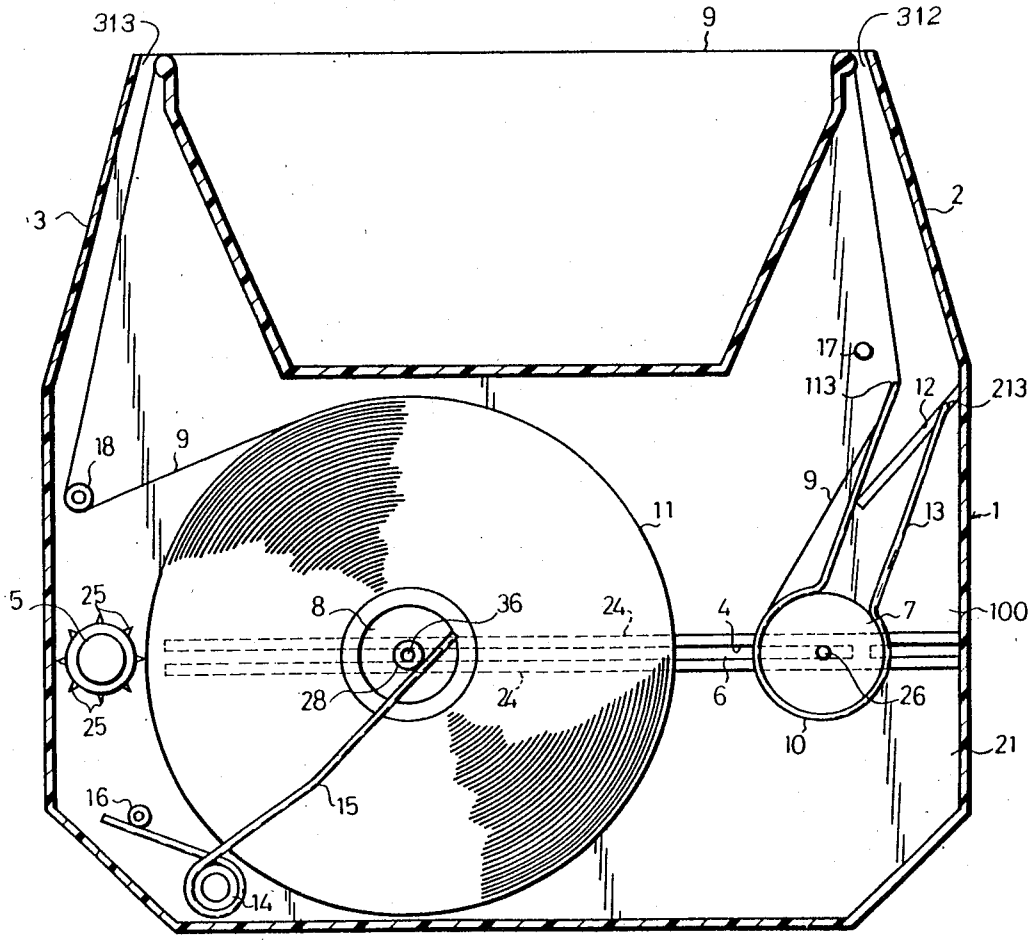
FIG. 2 is a view similar to FIG. 1, but showing the printing ribbon which has been almost completely used.

A wire spring 15 has a coiled intermediate portion wound on a support 14 provided between the top and bottom walls 31 and 21 of the casing in the vicinity of the take-up spool 11, as shown in FIGS. 1 and 2. The spring 15 has one end engaged on a support pin 16 secured to the casing 1, while the other end of the spring 15 is engaged on the boss 28 of the shaft 8 for the take-up spool 11 to urge the take-up spool 11 toward the drive roller 5.

If the printer in which the ribbon cassette is mounted is placed in operation, a printing hammer not shown is struck against the daisy-type-wheel 30 to bring the daisy-type-wheel 30 and the printing ribbon 9 into striking contact with printing paper not shown on a platen not shown, either, to effect printing thereon. The printing operation of the daisy-type-wheel 30 gives rise to slight movement of the printing ribbon 9 away from the supply spool 10. This movement gives rise to the displacement of one end 113 of the ribbon tensioner 13 as shown by two-dot chain lines in FIG. 1 against the spring force of the ribbon tensioner 13. Upon completion of each printing operation, however, the end 113 of the ribbon tensioner 13 is resiliently brought back to its normal position shown by solid lines. The printing ribbon 9 is, therefore, always held in tension without loosening despite the repeated printing operation. Each printing operation causes the drive roller 5 to rotate at a predetermined rate counterclockwise in FIG. 1, while maintaining the engagement of its projections 25 with the outer periphery of the take-up spool 11. The used portion of the printing ribbon 9 is, thus, wound on the take-up spool 11, while the unused portion of the printing ribbon 9 is supplied from the supply spool 10 to the printing zone.

The gradual use of the printing ribbon 9 results in a decreasing diameter of the printing ribbon 9 on the supply spool 10 and a correspondingly increasing diameter of the printing ribbon 9 on the take-up spool 11, as shown in FIG. 2. As the drive roller 5 is stationary, the take-up spool 11 is displaced to the right along the guide groove 4 with the connecting member 6 by overcoming the force of the spring 15. The supply spool 10, which is supported on the connecting member 6, is, therefore, displaced to the right along the guide groove 4, too. In other words, a reduction arises in the space requirement for the printing ribbon 9 on the supply spool 10 as a result of its decreasing diameter, and enables the supply spool 10 to move to the right and thereby create an additional space for accommodating the printing ribbon 9 having an increasing diameter on the take-up spool 11, while the distance between the two spool shafts 7 and 8 is unchanged. This enables the effective use of the internal space of the cassette even if it may be considerably small. The spool shafts 7 and 8 and the spools 10 and 11 are all supported on the guide rails 24 projecting above the bottom wall 21 of the casing 1. This means that the shafts 7 and 8 and the spools 10 and 11 contact only a limited area of the casing 1, and are, therefore, movable smoothly.

The displacement of the supply 10 to the right causes the displacement of the ribbon tensioner 13 in the same direction. Upon the movement of the ribbon tensioner 13, the end 213 of the ribbon tensioner 13 is moved along the guide groove 12 in order to cause no appreciable change in the tension applied by the ribbon tensioner 13 to the printing ribbon 9. Accordingly there does not occur any appreciable change in the angle of the ribbon tensioner 13 and the distance between the ends 113 and 213 thereof. The printing ribbon 9 is held in a constant range of tension irrespective of the displacement of the supply spool 10.

While the invention has been described with reference to a preferred embodiment thereof, it is to be understood that modifications or variations may be easily made by anybody of ordinary skill in the art without departing from the spirit and scope of this invention as defined by the appended claims. For example, the guide groove 12 may be replaced by a wall or like structure along which the end 213 of the ribbon tensioner 13 is movable to maintain a constant range of tension on the printing ribbon 9.

What is claimed is:

1. A printing ribbon cassette comprising:

(a) a supply spool carrying a printing ribbon thereon, and having an axis of rotation which is movable as said ribbon is released from said supply spool;

(b) a take-up spool on which said ribbon released from said supply spool is wound;

(c) a casing accommodating said supply and take-up spools;

(d) a ribbon tensioner having a base end supported on a shaft for said supply spool and a pair of free ends, one of said free ends being engaged with said ribbon released from said supply spool to apply tension to said ribbon; and (e) a guide means provided in said casing, the other of said free ends of said ribbon tensioner being movably engaged with said guide means in accordance with the displacement of said supply spool to enable said one end of said ribbon tensioner to maintain a constant range of tension on said ribbon.

2. A printing ribbon cassette as set forth in claim 1, wherein said ribbon tensioner comprises a bifurcate wire spring provided in said casing, said base end being rotatably supported on said supply spool shaft, while said free ends extend radially outwardly of said supply spool toward said guide means.

3. A printing ribbon cassette as set forth in claim 2, wherein said casing has a top wall and a bottom wall, said supply spool is located on said bottom wall, said guide means comprises a guide groove formed in said bottom wall and said ribbon tensioner is located at the top of said supply spool, said free ends of said ribbon tensioner being perpendicularly downwardly bent, said one free end pressing one side of ribbon, while said other free end is slidable in said guide groove.

4. A printing ribbon cassette as set forth in claim 3, wherein said guide groove is straight and extends at an angle to a sidewall of said casing.

5. A printing ribbon cassette as set forth in claim 1, further including a connecting member extending between said supply and take-up spools to enable said supply and take-up spools to move together, and a pair of guide rails provided in said casing and defining therebetween a guide groove along which said connecting member is movable.

6. A printing ribbon cassette as set forth in claim 5, wherein said casing has a top wall and a bottom wall, said guide rails being provided on said bottom wall, said supply and take-up spools being movably supported on said guide rails.

7. A printing ribbon cassette comprising:

(a) a supply spool carrying a printing ribbon thereon and having an axis of rotation which is movable as said ribbon is released from said supply spool;

(b) a take-up spool on which said ribbon released from said supply spool is wound, said take-up spool having an axis of rotation which is movable as said ribbon is wound on said take-up spool;

(c) a casing accommodating said supply and take-up spools;

(d) a member connecting said supply and take-up spools to enable said supply and take-up spools to move together;

(e) guide rails provided in said casing, and along which said connecting member is movable;

(f) a drive roller secured to said casing rotatably and engageably with the outer peripheral surface of said take-up spool to rotate said take-up spool;

(g) means urging said outer peripheral surface of said take-up spool into contact with said drive roller, said take-up spool being movable against the force of said urging means as said take-up spool is rotated to take up a roll of said ribbon, resulting in having an increasing diameter, said movement of said take-up spool causing said connecting member and said supply spool to move together;

(h) a ribbon tensioner provided in said casing and having a base end supported on a shaft for said supply spool and a pair of free ends, one of said free ends being engaged with said ribbon released from said supply spool to apply tension to said ribbon; and (i) guide means provided in said casing, the other of said free ends of said ribbon tensioner being engaged with said guide means movably with the movement of said supply and take-up spools to enable said one free end to maintain a constant range of tension on said ribbon.

8. A printing ribbon cassette as set forth in claim 7, wherein said urging means comprises a wire spring having an intermediate base portion wound on a support and a pair of free ends, one of said free ends of said spring being engaged on a support, while the other free end of said spring is engaged on a boss on a shaft for said take-up spool, said drive roller having on its outer periphery a plurality of projections which are engageable with said outer peripheral surface of said take-up spool to drive said take-up spool for rotation.

9. A printing ribbon cassette as set forth in claim 8, wherein said casing has a top wall and a bottom wall, said guide rails being provided on said bottom wall, said supply and take-up spools being movably supported on said guide rails.

* * * * *